US009803934B2

(12) United States Patent
Smith et al.

(10) Patent No.: US 9,803,934 B2
(45) Date of Patent: Oct. 31, 2017

(54) REFRIGERANT OUTLET DEVICE OF A CONDENSER

(71) Applicant: TRANE INTERNATIONAL INC., Piscataway, NJ (US)

(72) Inventors: Todd Smith, Onalaska, WI (US); Frederick Byron Hamm, Jr., Onalaska, WI (US); Steven Joseph Pitts, La Crescent, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 14/763,445

(22) PCT Filed: Jan. 24, 2014

(86) PCT No.: PCT/US2014/013024
§ 371 (c)(1),
(2) Date: Jul. 24, 2015

(87) PCT Pub. No.: WO2014/117002
PCT Pub. Date: Jul. 31, 2014

(65) Prior Publication Data

US 2015/0362260 A1 Dec. 17, 2015

Related U.S. Application Data

(60) Provisional application No. 61/756,661, filed on Jan. 25, 2013.

(51) Int. Cl.
*F28F 1/00* (2006.01)
*F25B 39/04* (2006.01)
*F28F 17/00* (2006.01)

(52) U.S. Cl.
CPC ..... *F28F 1/00* (2013.01); *F25B 39/04* (2013.01); *F28F 17/005* (2013.01)

(58) Field of Classification Search
CPC ..... F25B 2339/041; F25B 2339/044; F25B 2339/0442; F25B 2339/0446; F25B 39/04;
(Continued)

(56) References Cited

U.S. PATENT DOCUMENTS 3,304,697 A * 2/1967 Ramsey ..... B01D 45/12 55/459.1
3,396,611 A 8/1968 Smith
(Continued)

FOREIGN PATENT DOCUMENTS

CN 1316636 A 10/2001
CN 1322289 A 11/2001
(Continued)

OTHER PUBLICATIONS

International Search Report and Written Opinion for International Application No. PCT/US2014/013024, dated May 15, 2014, 10 pgs.

*Primary Examiner* — Cassey D Bauer
(74) *Attorney, Agent, or Firm* — Hamre, Schumann, Mueller & Larson, P.C.

(57) ABSTRACT

A condenser equipped with a refrigerant outlet configured to receive and store liquid refrigerant during an off-cycle is described. The refrigerant outlet may include an outflow pipe surrounded by a weir. The weir may include a port, through which liquid refrigerant in the weir can be directed to, for example, moving parts of the chiller for lubrication. The outflow pipe may extend vertically relative to the bottom of the condenser. In some embodiments, a first opening of the outflow pipe may be positioned higher than the bottom of the condenser in the vertical direction, while the weir may be positioned lower than the bottom of the condenser. Liquid refrigerant in the condenser can flow to and stay in the weir in an off-cycle. During a subsequent
(Continued)

start-up, the liquid refrigerant in the weir can be directly quickly to moving parts of the chiller.

15 Claims, 5 Drawing Sheets

(58) Field of Classification Search
CPC ..... F25B 43/02; F25B 43/006; F25B 45/00; F28D 1/0435; F28B 9/08; F28B 9/04; F28F 9/0246; F28F 17/005; F28F 25/04
See application file for complete search history.

(56) References Cited

U.S. PATENT DOCUMENTS 3,499,296 A * 3/1970 Osborne ..... F25B 41/06 62/115
3,837,175 A 9/1974 Miller
4,068,493 A 1/1978 Micai et al.
4,516,916 A 5/1985 English et al.
4,918,944 A 4/1990 Takahashi et al.
5,190,121 A 3/1993 Muzyk
5,881,564 A * 3/1999 Kishimoto ..... F04D 27/0292 418/102
6,065,297 A 5/2000 Tischer et al.
6,158,503 A * 12/2000 Gille ..... B60H 1/3227 165/132
6,176,092 B1 1/2001 Butterworth et al.
6,457,325 B1 10/2002 Vetter
6,685,358 B2 2/2004 Harclerode
7,395,678 B2 7/2008 Arno et al.
8,234,877 B2 8/2012 Beekman et al.
8,402,780 B2 3/2013 Wiggs
2001/0037651 A1 11/2001 Butterworth et al.
2005/0126764 A1 * 6/2005 Alinovi ..... F25B 39/04 165/119
2009/0158762 A1 * 6/2009 Eber ..... F25B 39/04 62/196.4

FOREIGN PATENT DOCUMENTS

CN 1322290 A 11/2001
JP 2002-318018 10/2002
KR 10-2012-0041186 4/2012
KR 101175777 B1 8/2012

* cited by examiner

REFRIGERANT OUTLET DEVICE OF A CONDENSER

FIELD

The disclosure herein relates to heating, ventilation, and air-conditioning ("HVAC") systems, such as for example a chiller, and more particularly to a condenser of a chiller system. Generally, methods, systems, and apparatuses are described that are directed to a refrigerant outlet device of a condenser in a chiller.

BACKGROUND

A HVAC system, such as a chiller, generally includes a compressor, a condenser, an evaporator and an expansion device. In a cooling cycle of the HVAC system, the compressor can compress refrigerant vapor, and the compressed refrigerant vapor may be directed into the condenser to be condensed into liquid refrigerant. The liquid refrigerant can then be expanded by the expansion device and directed into the evaporator.

Components of the HVAC system, such as the compressor, may include moving parts, and therefore may require lubrication during operation. Lubricants, such as oil, are commonly used in the HVAC system to provide lubrication.

SUMMARY

Embodiments provided herein relate to methods, systems and apparatuses configured to help provide lubrication in a HVAC system. In some HVAC systems, liquid refrigerant can be used to provide lubrication to, for example, moving parts, such as a bearing of a compressor. During an off-cycle, the compressor is turned off. Liquid refrigerant on the moving parts can vaporize, causing potential lack of liquid refrigerant for lubrication during the subsequent start-up. This may cause abnormal wear to the moving parts due to lack of lubrication, shortening the service lives of the moving parts. Improvements can be made to the HVAC system so that liquid refrigerant can be provided relatively fast, for example, to the moving parts, during for example a start-up.

A condenser equipped with a refrigerant outlet configured to receive and store liquid refrigerant, such as for example during an off-cycle. is described. In some embodiments, the refrigerant outlet may include an outflow pipe and an outer wall surrounding the outflow pipe. An outside surface of the outflow pipe and the outer wall can define an annular weir surrounding the outflow pipe. The annular weir can act as a reservoir to receive and store liquid refrigerant during, for example, an off-cycle. In some embodiments, after a start-up, the liquid refrigerant can be directed to the annular weir before flowing out of the outflow pipe so that the liquid refrigerant can be available in the annular weir.

In some embodiments, the outer wall may include a port in fluid communication with the weir. The port can be configured to direct the liquid refrigerant out of the weir to, for example, moving parts for lubrication. The moving parts may include, for example, a bearing of a compressor.

In some embodiments, the weir may be positioned below a bottom of the condenser in the vertical direction. The liquid refrigerant may be preferentially directed toward the weir before flowing out of the first end of the outflow pipe.

In some embodiments, the outflow pipe may have a first end and a second end, the first end is configured to be positioned inside the condenser, and the first end may be configured to be positioned in a vertical direction that is higher than an opening of the weir in a vertical direction.

In some embodiments, the port of the outer wall has a diameter, the outer wall and the outside surface of the outflow pipe have a distance therebetween, and the distance may be about the same as the diameter of the port.

The weir has a bottom in the vertical direction and the port has in the vertical direction a lowest point toward the bottom of the weir. In some embodiments, the lowest point of the port may be positioned in the vertical direction higher than the bottom of the weir.

In some embodiments, a method of providing liquid refrigerant during a start-up of a HVAC system may include: directing liquid refrigerant out of a condenser during an off-cycle; storing the liquid refrigerant in the reservoir; and directing the liquid refrigerant stored in the reservoir out of the reservoir during a HVAC system start-up. In some embodiments, a method of providing liquid refrigerant after a start-up of a HVAC system may include: preferentially directing liquid refrigerant toward a reservoir before the liquid refrigerant flowing out of an outflow pipe, and directing the liquid refrigerant out of the reservoir. In some embodiments, the liquid refrigerant can be directed out of the condenser from a location of the condenser that accumulates liquid refrigerant.

Other features and aspects of the fluid management approaches will become apparent by consideration of the following detailed description and accompanying drawings.

BRIEF DESCRIPTION OF THE DRAWINGS

Reference is now made to the drawings in which like reference numbers represent corresponding parts throughout.

FIG. 1A illustrates a portion of the condenser that includes the refrigerant outlet. FIG. 1B illustrates an enlarged sectional view of the refrigerant outlet. FIG. 1C illustrates a top sectional view of the refrigerant outlet along the line 1C-1C in FIG. 1B.

DETAILED DESCRIPTION

Figure 1A:
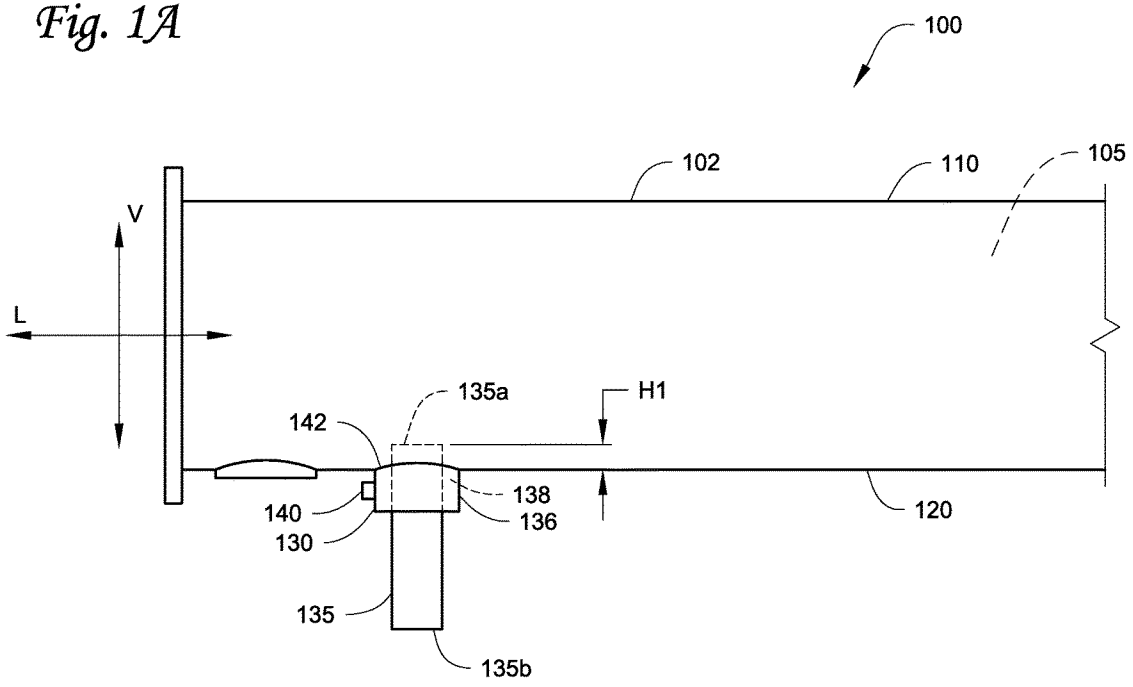
FIGS. 1A to 1C illustrate a condenser equipped with a refrigerant outlet, according to one embodiment.

A HVAC system, such as a chiller system, may commonly include components with moving parts, such as a bearing of a compressor. The moving parts generally require proper lubrication. The lubrication is commonly provided by lubricants, such as oil. In some HVAC systems, the lubrication can be provided by liquid refrigerant. Such a HVAC system is sometimes called an oil-free system. In the oil-free system, liquid refrigerant can be directed to surfaces of the moving parts for lubrication. The liquid refrigerant on the moving parts may be vaporized, because the refrigerant has a relatively low boiling temperature. During an off-cycle, for example, the liquid refrigerant on the moving parts may be vaporized. When the HVAC system subsequently starts up from an off-cycle, the surfaces of the moving parts may not have sufficient liquid refrigerant to provide lubrication, potentially causing abnormal wear on the moving parts. Improvement can be made to direct liquid refrigerant to the moving parts relatively quickly when, for example, the HVAC system starts up from an off-cycle.

The embodiments as disclosed herein describe methods, systems and apparatuses directed to a refrigerant outlet of a condenser that can receive and store liquid refrigerant during, for example, an off-cycle. The stored liquid refrigerant can be directed relatively quickly to, for example, moving parts during the subsequent start-up. The refrigerant outlet may include an outflow pipe and a weir. In some embodiments, the weir may be an annular reservoir surrounding the outflow pipe. In some embodiments, the refrigerant outlet can be positioned below a bottom of the condenser so that liquid refrigerant in the condenser can flow to the weir. The weir may include a port, through which liquid refrigerant in the weir can be directed to, for example, moving parts of the chiller. In some embodiments, the outflow pipe may extend vertically relative to the bottom of the condenser. In some embodiments, a first opening of the outflow pipe may be positioned inside the condenser and may be positioned higher than the bottom of the condenser; while the weir may be positioned lower than the bottom of the condenser. In some embodiments, when the chiller is in an off-cycle, liquid refrigerant in the condenser can flow to and be stored in the weir. During the subsequent start-up, the liquid refrigerant in the weir can be directed relatively quickly to moving parts of the chiller. In some embodiments, such as after start-up and/or during an off cycle, the liquid refrigerant can be preferentially directed to the weir before the liquid refrigerant flowing out of the outflow pipe so that liquid refrigerant may be available in the weir as needed for, for example, lubrication.

References are made to the accompanying drawings that form a part hereof, and in which is shown by way of illustration of the embodiments in which the embodiments may be practiced. The term "off-cycle" generally means that a compressor of a HVAC system is not in operation. The term "start-up" generally means that the HVAC starts to operate from an off-cycle. It is to be understood that the terms used herein are for the purpose of describing the figures and embodiments and should not be regarding as limiting the scope of the present application.

Figure 1B:
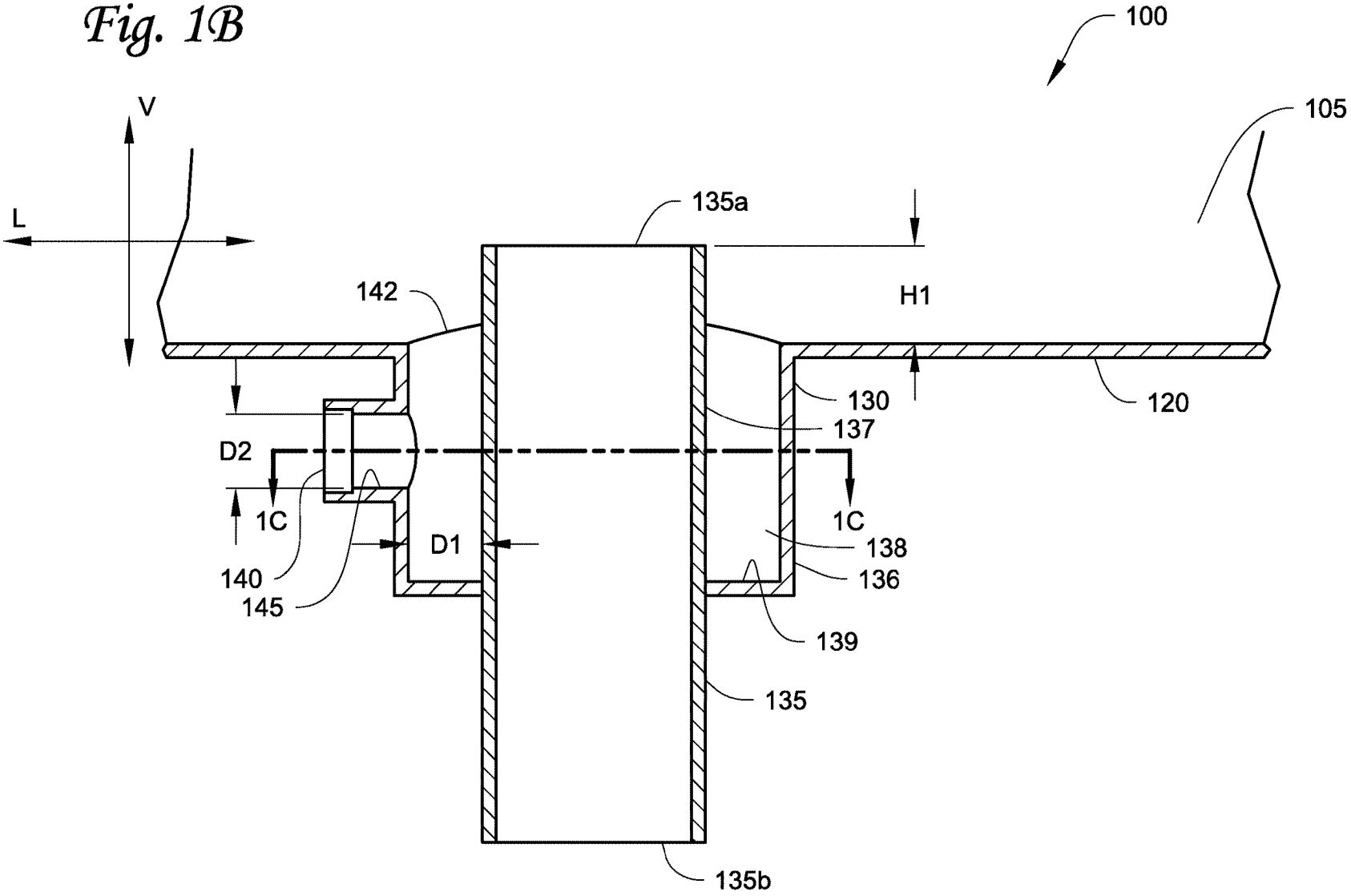
Figure 1C:
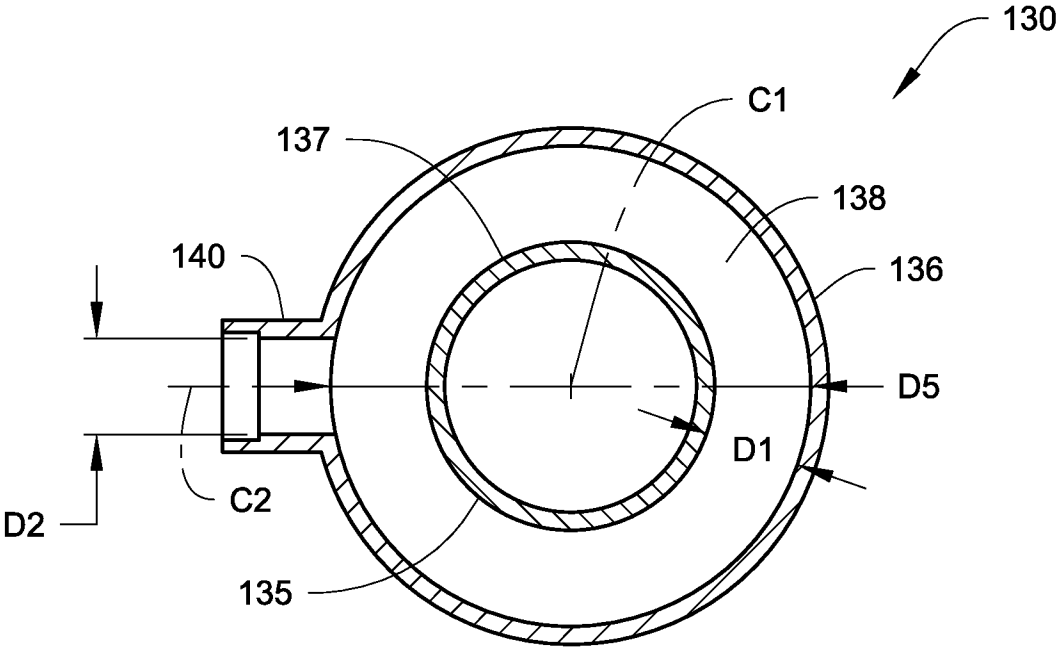

FIGS. 1A to 1C illustrate a portion of a condenser 100 of, for example, a chiller system (not shown). As shown in FIG. 1A, the illustrated condenser 100 is a shell-and-tube type condenser, which may be commonly found in a commercial chiller system. In the illustrated configuration, the condenser 100 has a longitudinal direction L and a vertical direction V. The condenser 100 has a shell 102 that defines an inner space 105, which has a top 110 and a bottom 120. The condenser 100 may be configured to condense compressed refrigerant vapor to liquid refrigerant in the space 105. The liquid refrigerant is typically accumulated on the bottom 120 of the condenser 100.

A refrigerant outlet 130 is attached to the shell 102 on the bottom 120. In some embodiments, the refrigerant outlet 130 may be attached to the shell 102 at about the lowest point of the shell 102 in the vertical direction V.

The refrigerant outlet 130 includes an outflow pipe 135 and an outer wall 136 that surrounds the outflow pipe 135. The outer wall 136 and an outside surface 137 (see FIG. 1B) of the outflow pipe 135 define a weir 138 that surrounds the outflow pipe 135. In the embodiment shown, the weir 138 is positioned below the bottom 120 of the condenser 100. The outer wall 136 includes a port 140 that forms fluid communication with the weir 138. The weir 138 has an opening 142 on the bottom 120, through which the weir 138 forms fluid communication with the space 105. (See FIG. 1B)

The outflow pipe 135 is configured to extend in the vertical direction V and form fluid communication with the space 105. The outflow pipe 135 has a first opening 135*a* positioned inside the space 105 and a second opening 135*b* positioned outside the space 105. As illustrated in FIG. 1A, the first opening 135*a* is configured to be higher than the bottom 120 of the condenser 100 in the vertical direction V, and has a height H1 relative to the bottom 120 of the condenser 100 in the vertical direction V. In some embodiments, the height H1 can be about 1 to about 1.3 inches, and can be somewhat higher or lower as may be desired and/or needed. The height H1 may be configured so that liquid may be preferentially directed toward the weir 138 before flowing out of the outflow pipe 135.

FIG. 1B is an enlarged sectional view of a portion of the condenser 100 that includes the refrigerant outlet 130. As illustrated, the outer wall 136 and the outside surface 137 of the outflow pipe 135 define the weir 138. The weir 138 is in fluid communication with the space 105 independently from the outflow pipe 135. The outside surface 137 of the outflow pipe 135 and the outer wall 136 have a distance D1 in the longitudinal direction L as shown. Generally, the larger the distance D1, the easier liquid refrigerant can flow into the weir 138. The distance D1 can be configured so that liquid refrigerant can flow into the weir 138 relatively easily, or the distance D1 does not create restriction to the liquid refrigerant flowing into the weir 138.

The port 140 has a diameter D2. In some embodiments, the distance D1 is about the same as the diameter D2.

As illustrated in FIG. 1B, the port 140 is positioned higher than a bottom 139 of the weir 138. The port 140 has a lowest portion 145 in the vertical direction V. The lowest portion 145 is higher than the bottom 139 in the vertical direction V. When the weir 138 contains the liquid refrigerant, precipitates in the liquid refrigerant may accumulate on the bottom 139 of the weir 138. Positioning the lowest portion 145 of the port 140 higher than the bottom 139 can help reduce the precipitates flowing out of the weir 138 from the port 140.

FIG. 1C is a top sectional view of the refrigerant outlet 130 along the line 1C-1C in FIG. 1B. As illustrated, the outflow pipe 135 and the outer wall 136 generally have a circular profile, with the understanding that the outer wall 136 and/or the outflow pipe 135 can have a profile of other shapes. The outflow pipe 135 and the outer wall 136 are generally concentric and define the annular weir 138 surrounding the outflow pipe 135 in the illustrated embodiment.

Referring to FIGS. 1A to 1C, when in operation, liquid refrigerant can accumulate at the bottom 120 of the condenser 100 and can flow to the weir 138. The liquid refrigerant accumulated in the weir 138 can be directed out of the weir 138 from the port 140 to, for example, a compressor (not shown) to lubricate moving ports of the compressor, such as a bearing of the compressor.

The outflow pipe 135 is configured to direct liquid refrigerant out of the condenser 100. And the refrigerant can be directed toward such as for example an evaporator or an economizer (not shown). The liquid refrigerant can flow from the first end 135*a* to the second end 135*b* of the outflow pipe 135. Because the first end 135*a* of the outflow pipe 135 is positioned higher than the bottom 120 (e.g. the height H1 is about 1 inch in FIG. 1A), while the weir 138 is positioned lower than the bottom 120 in the vertical direction V, the weir 138 may contain the liquid refrigerant before the liquid refrigerant can flow out of the condenser 100 from the outflow pipe 135. After a start-up, for example, the liquid refrigerant may be preferentially directed toward the weir 138 before the liquid refrigerant flowing out from the outflow pipe 135, so that the weir 138 can generally have liquid refrigerant available for, for example, providing lubrication to areas of the system that may have a need.

When the HVAC system is in an off-cycle, for example, liquid refrigerant may be emptied from the outflow pipe 135. The condenser 100 may generally still have some liquid refrigerant condensing during the off-cycle. Because the weir 138 is positioned below the bottom 120, the weir 138 can receive and store the liquid refrigerant left in the condenser 100 during the off-cycle. When the HVAC system starts up subsequently, the weir 138 can provide liquid refrigerant stored during the off-cycle. During the off-cycle, the weir 138 can function as a liquid refrigerant reservoir. During normal operation condition, the weir 138 can generally receive liquid refrigerant from the condenser and store the liquid refrigerant.

It is to be appreciated that the refrigerant outlet 130 may be used with other types of condensers than shell-and-tube condensers. Generally, the refrigerant outlet 130 can be attached to a location of a condenser that can accumulate or have liquid refrigerant during an off-cycle. In some embodiments, a method of providing lubricating liquid refrigerant relatively quickly during start-up may include directing liquid refrigerant out of a condenser during an off-cycle; storing the liquid refrigerant in a reservoir (such as the weir 138 in FIG. 1A); and directing the stored liquid refrigerant out of the reservoir during a subsequent start-up.

It is to be appreciated that a component of the HVAC system, other than a condenser, that may be able to pool liquid refrigerant during certain operation conditions and/or during the off-cycle may be potentially used as a source of liquid refrigerant for providing lubricating liquid refrigerant. The refrigerant outlet 130 may be configured to be suitably applied to such components, e.g. an evaporator, or other heat exchangers.

Figure 2:
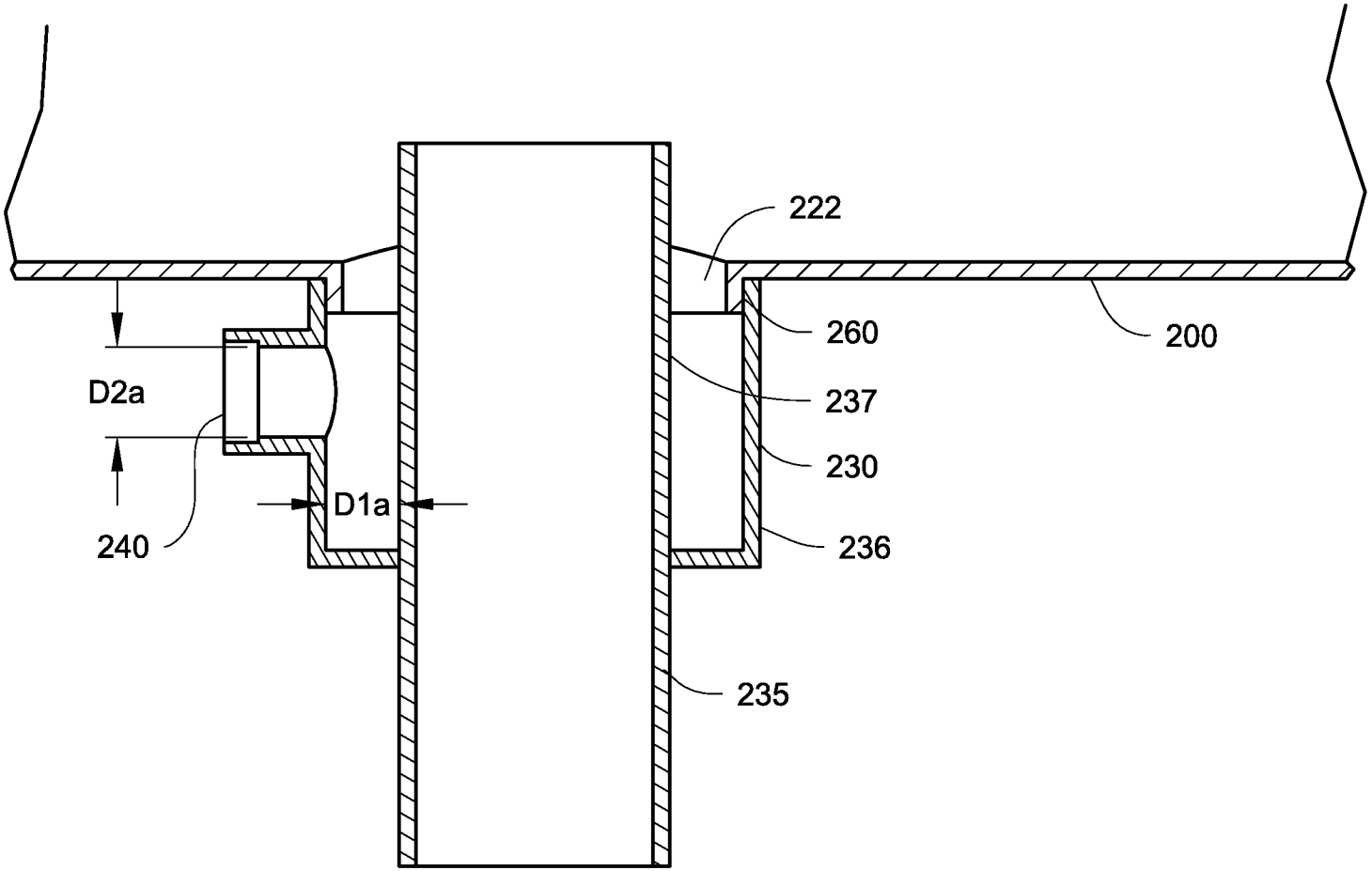
FIG. 2 illustrates a sectional view of a condenser equipped with a refrigerant outlet, according to another embodiment.

As illustrated in FIGS. 1A and 1B, the refrigerant outlet 130 can be an integrated part of the shell 102 of the condenser 100. This is exemplary. FIG. 2 illustrates another embodiment of the refrigerant outlet 230 that is attached to a condenser 200. The condenser 200 has an outlet port 222. An outer wall 236 of the refrigerant outlet 230 can be removably coupled to the outlet port 222 via, for example, threads 260. FIG. 2 also illustrates that distance D1*a* between an outside surface 237 of the outflow pipe 235 to the outer wall 236 can be smaller than a diameter D2*a* of a port 240, which may help pool the refrigerant faster between the outer wall 236 and the outside surface 237 of the outflow pipe 235. It is to be appreciated that the diameters and distances shown and described herein can be suitably applied to any of the embodiments, configurations shown and described in FIGS. 1 to 4.

Figure 3:
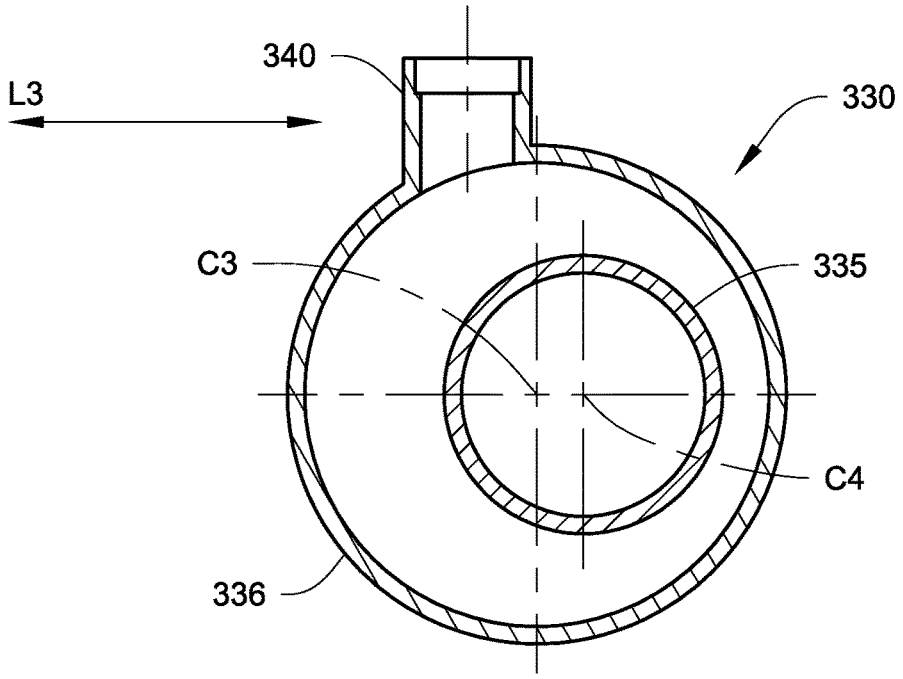
FIG. 3 illustrates another embodiment of a refrigerant outlet.

As illustrated in FIG. 1C, the port 140 can roughly extend along a diameter D5 of the circular profile of the outer wall 136. That is, a centerline C2 of the port 140 generally extend through a center C1 of the circular profile of the outer wall 136. This is exemplary. FIG. 3 illustrates another embodiment of a refrigerant outlet 330. An outer wall 336 can be not concentric with an outflow pipe 335. In the orientation as shown in FIG. 3, a port 340 of the outer wall 336 is positioned toward a side that is different from the outflow pipe 335 relative to a center C3 of the outer wall 336 in a longitudinal direction L3, so that the outflow pipe 335 and the outer wall 336 may be eccentrically arranged where the port 340 is off-set in the longitudinal direction L3 relative to a center C4 of the outflow pipe 335.

Figure 4:
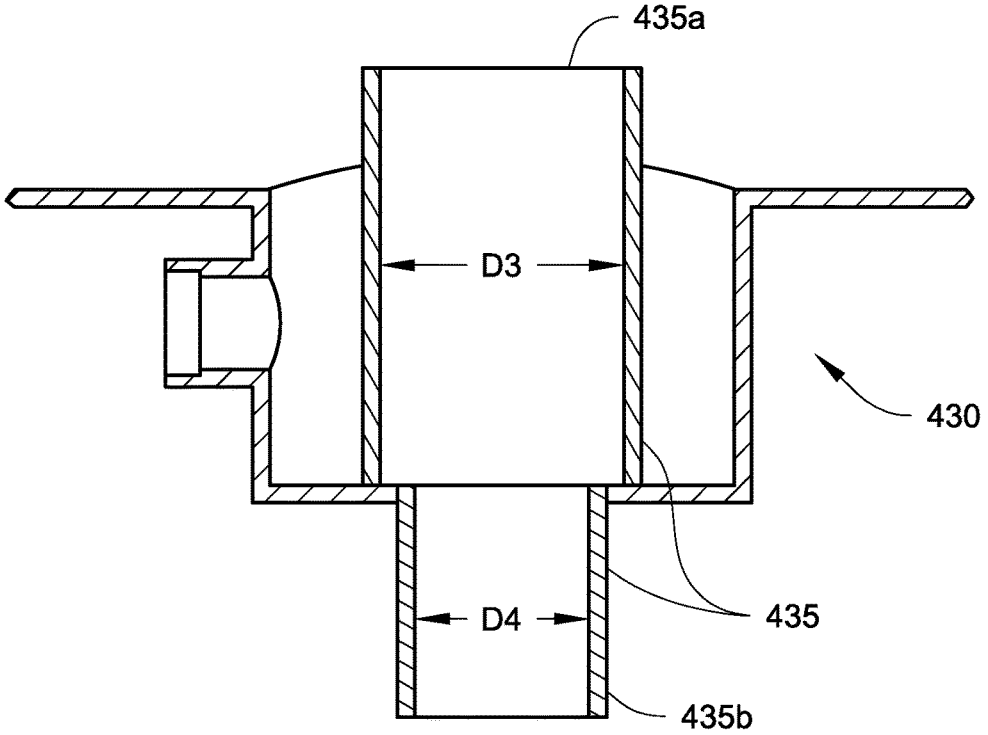
FIG. 4 illustrates yet another embodiment of a refrigerant outlet.

As illustrated in FIGS. 1A and 1B, the outflow pipe 135 is a straight pipe, which has a relatively uniform diameter. This is exemplary. As illustrated in FIG. 4, an outflow pipe 435 of a refrigerant outlet 430 may include two sections 435*a* and 435*b* that have different diameters D3 and D4 respectively. In some embodiments, the diameter D3 can be larger than D4. In some embodiments, the diameter D3 can be smaller than D4 or they can be about the same diameter.

Aspects

Any of aspects 1 to 6 can be combined with any of aspects 7-17. Any of aspects 7-15 can be combined with any of aspects 16, 17.

Aspect 1. A refrigerant outlet of a heat exchanger, comprising:

an outflow pipe;

an outer wall surrounding the outflow pipe, an outside surface of the outflow pipe and the outer wall define an annular weir surrounding the outflow pipe; and a port on the outer wall in fluid communication with the weir;

wherein the outflow pipe has a first end and a second end, the weir has an opening, and the first end is configured to be positioned higher than the opening of the weir when the refrigerant outlet is installed on the heat exchanger.

Aspect 2. The refrigerant outlet of aspect 1, wherein the port of the outer wall has a diameter, the outer wall and the outside surface of the outflow pipe has a distance therebetween, and the distance is about the same as the diameter.

Aspect 3. The refrigerant outlet of aspects 1-2, wherein the weir has a bottom, the port has a lowest point, and the lowest point is positioned higher than the bottom of the weir when the refrigerant outlet is installed to the condenser.

Aspect 4. The refrigerant outlet of aspects 1-3, wherein the refrigerant outflow pipe has a first section with a first diameter and a second section with a second diameter, and the first diameter is different from a second diameter.

Aspect 5. The refrigerant outlet of aspects 1-4, wherein the outer wall and the outflow pipe have circular profiles, and the circular profile of the outer wall and the circular profile of the outflow pipe are concentrically positioned.

Aspect 6. The refrigerant outlet of aspects 1-5, wherein the outer wall and the outflow pipe have circular profiles, and the circular profile of the outer wall the circular profile of the outflow pipe are eccentrically positioned.

Aspect 7. A heat exchanger, comprising:

a shell having a bottom, the shell defining a space; and a refrigerant outlet installed on the bottom of the shell;

wherein the refrigerant outlet includes an outflow pipe;

an outer wall surrounding the outflow pipe, the outflow pipe and an outside surface of the outer wall define an annular weir surrounding the outflow pipe;

a port on the outer wall in fluid communication with the weir; the outflow pipe has a first end and a second end, the first end is configured to be positioned inside the shell; the weir has an opening in fluid communication with the space; and the first end is configured to be positioned higher than the opening of the weir.

Aspect 8. The heat exchanger of aspect 7, wherein the port of the outer wall has a diameter, the outer wall and the outside surface of the outflow pipe has a distance therebetween, and the distance is about the same as the diameter.

Aspect 9. The heat exchanger of aspects 7-8, wherein the weir has a bottom, the port has a lowest point, and the lowest point is positioned higher than the bottom of the weir.

Aspect 10. The heat exchanger of aspects 7-9, wherein the refrigerant outflow pipe has a first section with a first diameter and a second section with a second diameter, and the first diameter is different from a second diameter.

Aspect 11. The heat exchanger of aspects 7-10, wherein the outer wall and the outflow pipe have circular profiles, and the circular profile of the outer wall and the circular profile of the outflow pipe are concentrically positioned.

Aspect 12. The heat exchanger of aspects 7-11, wherein the outer wall and the outflow pipe have circular profiles, and the circular profile of the outer wall the circular profile of the outflow pipe are eccentrically positioned.

Aspect 13. The heat exchanger of aspects 7-12, wherein the outflow pipe has a first section with a first diameter, and a second section with a second diameter, and the first diameter is different from the second diameter.

Aspect 14. The heat exchanger of aspect 13, wherein the first diameter is larger than the second diameter.

Aspect 15. The heat exchanger of aspects 13-14, wherein the first section is positioned inside the shell of the heat exchanger.

Aspect 16. A method of providing liquid refrigerant in a HVAC system, comprising:

directing liquid refrigerant out of a condenser into a reservoir during an off-cycle;

storing the liquid refrigerant in the reservoir; and directing the liquid refrigerant stored in the reservoir out of the reservoir for lubrication during the HVAC system start-up.

Aspect 17. The method of providing liquid refrigerant in a HVAC system of aspect 16, further comprising:

after start-up, directing the liquid refrigerant preferentially toward the reservoir before the liquid refrigerant flows out of the condenser.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What is claimed is:

1. A refrigerant outlet of a heat exchanger, comprising:

an outflow pipe;

an outer wall surrounding the outflow pipe, an outside surface of the outflow pipe and the outer wall define an annular weir surrounding the outflow pipe; and a single port on the outer wall in fluid communication with the annular weir to direct liquid lubricating refrigerant out of the annular weir and through the port to provide lubrication to a compressor;

wherein the annular weir has a bottom, the port has a lowest point, and the lowest point of the port is positioned higher than the bottom of the annular weir, the outflow pipe has a first end and a second end, the annular weir has an opening in fluid communication with the port, and the first end of the outflow pipe is positioned higher than the opening of the annular weir.

2. The refrigerant outlet of claim 1, wherein the port on the outer wall has a diameter, the outer wall and the outside surface of the outflow pipe have a distance therebetween, and the distance is about the same as the diameter.

3. The refrigerant outlet of claim 1, wherein the refrigerant outflow pipe has a first section with a first diameter and a second section with a second diameter, and the first diameter is different from the second diameter.

4. The refrigerant outlet of claim 1, wherein the outer wall and the outflow pipe have circular profiles, and the circular profile of the outer wall and the circular profile of the outflow pipe are concentrically positioned.

5. The refrigerant outlet of claim 1, wherein the outer wall and the outflow pipe have circular profiles, and the circular profile of the outer wall the circular profile of the outflow pipe are eccentrically positioned.

6. A heat exchanger, comprising:

a shell having a bottom, the shell defining a space; and a refrigerant outlet on the bottom of the shell, the refrigerant outlet includes:

an outflow pipe;

an outer wall surrounding the outflow pipe, the outflow pipe and an outside surface of the outer wall define an annular weir surrounding the outflow pipe; and a port on the outer wall in fluid communication with the annular weir to direct liquid lubricating refrigerant out of the annular weir and through the port to provide lubrication to a compressor, wherein the annular weir has a bottom, the port has a lowest point, the lowest point of the port is positioned higher than the bottom of the annular weir, the outflow pipe has a first end and a second end, the first end of the outflow pipe is positioned inside the shell, the annular weir has an opening on the bottom of the shell, the opening is in fluid communication with the space and in fluid communication with the port, and the first end of the outflow pipe is positioned higher than the opening of the annular weir.

7. The heat exchanger of claim 6, wherein the port on the outer wall has a diameter, the outer wall and the outside surface of the outflow pipe have a distance therebetween, and the distance is about the same as the diameter.

8. The heat exchanger of claim 6, wherein the outer wall and the outflow pipe have circular profiles, and the circular profile of the outer wall and the circular profile of the outflow pipe are concentrically positioned.

9. The heat exchanger of claim 6, wherein the outer wall and the outflow pipe have circular profiles, and the circular profile of the outer wall the circular profile of the outflow pipe are eccentrically positioned.

10. The heat exchanger of claim 6, wherein the outflow pipe has a first section with a first diameter, and a second section with a second diameter, and the first diameter is different from the second diameter.

11. The heat exchanger of claim 10, wherein the first diameter is larger than the second diameter.

12. The heat exchanger of claim 10, wherein the first section is positioned inside the shell of the heat exchanger.

13. A heat exchanger, comprising:

a shell having a bottom, the shell defining a space; and a refrigerant outlet on the bottom of the shell, the refrigerant outlet includes:

an outflow pipe;

an outer wall surrounding the outflow pipe, the outflow pipe and an outside surface of the outer wall define an annular weir surrounding the outflow pipe; and a single port on the outer wall in fluid communication with the annular weir to direct liquid lubricating refrigerant out of the annular weir and through the port to provide lubrication to a compressor, wherein the port has a lowest point, the annular weir has a bottom, the lowest point of the port is positioned higher than the bottom of the annular weir, the outflow pipe has a first end and a second end, the first end of the outflow pipe is positioned inside the shell, the annular weir has an opening in fluid communication with the space and in fluid communication with the port, the first end of the outflow pipe is positioned higher than the opening of the annular weir, the outflow pipe is in fluid communication with the space, the outflow pipe and the annular weir are configured so that liquid lubricating refrigerant is first directed from the space into the annular weir before liquid lubricating refrigerant is directed to the outflow pipe through the first end of the outflow pipe.

14. The heat exchanger of claim 13, wherein the annular weir acts as a reservoir to receive and store liquid lubricating refrigerant during an off-cycle.

15. The heat exchanger of claim 6, wherein the bottom of the annular weir is positioned higher than the second end of the outflow pipe.

* * * * *